US005546803A

United States Patent [19]

Reynolds

[11] Patent Number: 5,546,803

[45] Date of Patent: Aug. 20, 1996

[54] SCOOP FOR COMPACTING AND MOLDING MASONARY MIXTURES

[76] Inventor: James R. Reynolds, 9502 384th. Ave. SE., Snoqualmie, Wash. 98065

[21] Appl. No.: 489,674

[22] Filed: Jun. 12, 1995

[51] Int. Cl.[6] ..... E04B 2/46

[52] U.S. Cl. ..... 73/427; 52/749.13

[58] Field of Search ..... 73/427, 32 R, 73/294; 405/266; 206/459.5; 52/747.11, 747.12, 749.1, 749.11, 749.13; 141/331

[56] References Cited

U.S. PATENT DOCUMENTS

| | | | |
|---|---|---|---|
| 42,684 | 5/1864 | Otis | 73/427 |
| 3,478,482 | 11/1969 | Weir | 52/749.13 |
| 3,696,576 | 10/1972 | de Barros | 52/747.12 |
| 4,226,268 | 10/1980 | Wasser | 141/331 |
| 4,352,445 | 10/1982 | Cusumano et al. | 52/749.13 |
| 5,458,169 | 10/1995 | Biafore | 52/749.13 |

*Primary Examiner*—Robert Raevis

[57] ABSTRACT

A multisided, slightly tapered open ended scoop which effectively economizes on the amount of masonry mixture and labor necessary to install masonry paving systems. The standard is formed of simple, inexpensive sturdy construction and provides a method to efficiently scoop up and deliver a compacted, molded and measured amount of masonry mixture, with a minimum effort. The quantity of masonry mixture used can be adjusted and the density of the finished molded mixture can be adjusted for varying masonry paver installations.

1 Claim, 1 Drawing Sheet

SCOOP FOR COMPACTING AND MOLDING MASONARY MIXTURES

BACKGROUND OF THE INVENTION

1. Field of the Invention

The present invention relates to a labor and material saving device for use in the installation of masonry paving systems. More specifically, the present invention relates to a device which a tradesman or any individual can use, in one fluid motion, to scoop up, compact, measure and mold a masonry mixture upon which masonry paving systems can then be placed.

2. Prior Art

The laying of heavy masonry or stone pavers is a tedious, labor intensive installation procedure. Specific to this generalized procedure is the forming of a concrete slab under the intended masonry walkway, with concrete curbs surrounding it. The concrete slab is sloped slightly to preinstalled drains and then protected by a waterproof membrane. The procedure is to now install masonry pavers or cut stone so their top edge is flush with the poured concrete curb with a joint of 1/8 to 1/16 of an inch between the masonry units and curbs and between each masonry unit so rain water can drain between them and be channeled to the drains beneath the masonry structure. In the past, pavers or other masonry units were laid upon masonry mixtures, wetpack or mortar, which had been tediously mounded up using a mason's trowel, under the four corners of rectangular pavers, or dumped in one large pile, under the center of a masonry unit, using a shovel. The tradesman would then "set" the paver material on the mounded up masonry mixture, level and square it up. There are multiple problems with this long used technique. The masonry mixture is an unformed mound, uncompacted and unregulated in size. This old technique requires the tradesman to relay a percentage of paving material that sink too low on the masonry mixture after they are placed. Also a considerable amount of masonry mixture is wasted and the waterproof membrane area under the paving structure becomes a mess of wetpack or mortar.

I noted that if the masonry mixture could be precompacted, making it denser, and molded into a general tapered geometric shape, with a larger area at its base tapering to a smaller area at its top, it could better withstand the downward force of the heavy masonry paving system. The savings in the amount of the masonry mixture used with a simple, onsite, regulated premolding system would be appreciable. This technique would reduce labor and fatigue, through less paving material having to be relaid and less masonry mixture having to be processed and handled with a resultant increase in job production.

No device is known, however, which would fulfill the purposes of the present invention, which would allow for the compaction, molding, measuring and delivery of a masonry mixture upon which to lay masonry paving systems.

SUMMARY OF THE INVENTION

In accordance with my invention, I overcome the above and other difficulties by providing a device which is of simple, inexpensive and sturdy construction.

The principal object of the present invention is to provide a device which would, with a minimum of effort, efficiently scoop up and deliver a compacted, molded and measured amount of masonry mixture for use under masonry paving systems.

It is also the object of the present invention to provide such a device which, in use, would effectively economize on the amount of masonry mixture and labor needed to lay paving systems.

A further object of the present invention is to provide such a device which, in use, would be quickly and easily utilized by tradesmen or individuals of varied skill levels.

The foregoing objects can be accomplished by providing a multisided, slightly tapered device having a handled on the exterior side, no top or bottom covers, with regularly spaced gradient marks on the inner sides. In the preferred embodiment of the invention, the standard is formed by a multiple of similar or equivalent, slightly tapered sides which are joined together on their longer edges with their two shorter edges forming a rectangular shaped opening on the open bottom and open top of the device with the top having the larger opening of rectangular shape. A handle is located on one exterior side, centered from side to side and top to bottom. On the inner sides are regularly spaced gradient measuring marks.

The invention is utilized by grasping the handle and with a scooping up motion it is filled with the masonry mixture from a mounded pile or tub, then lowered rapidly and impacted on its base on a solid unyielding work surface or floor. The invention is then inverted and its top tapped lightly on the work surface or floor to release the compressed, molded and premeasured masonry mixture onto the work surface.

The amount of masonry mixture used can be varied by filling the invention to the different interior gradient lines. The density of the finished molded mixture can be adjusted by varying the number of impacts and the amount of force used when impacting the base of the device on a solid unyielding work surface.

DESCRIPTION OF THE PREFERRED EMBODIMENT

Figure 1:
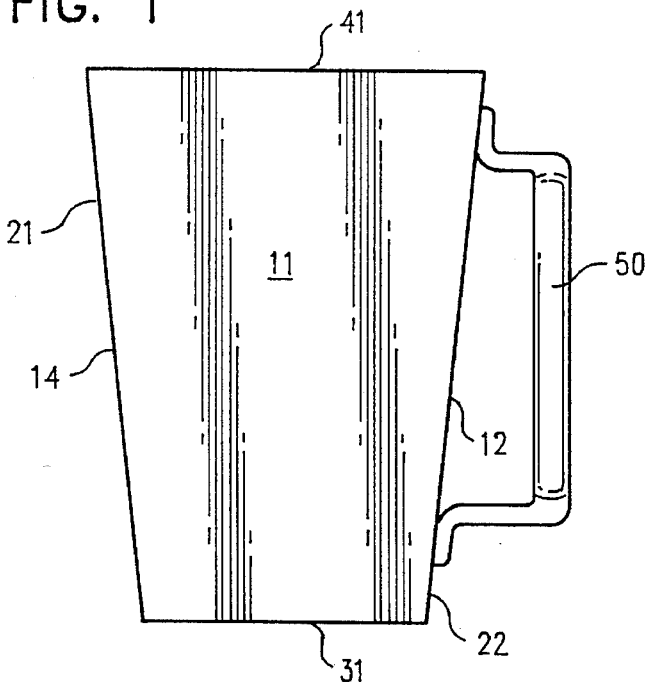
FIG. 1 is a side elevation view of a scoop for compacting, molding and measuring masonry mixtures in accordance with the present invention.
Figure 3:
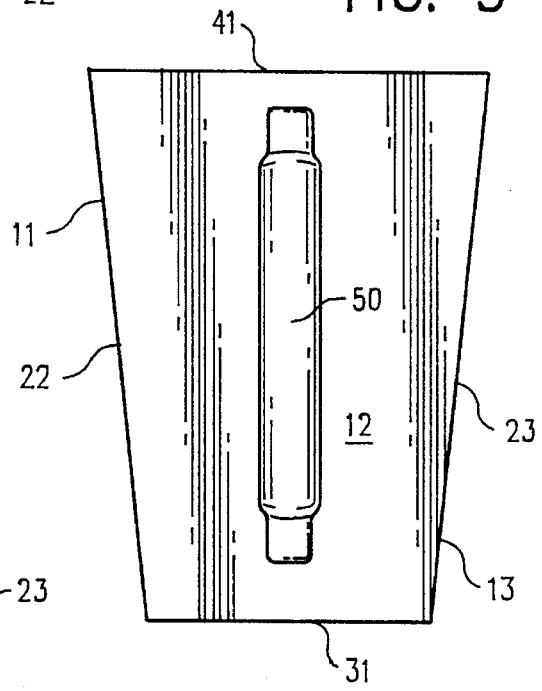
FIG. 3 is an elevation view of the handle side.
Figure 2:
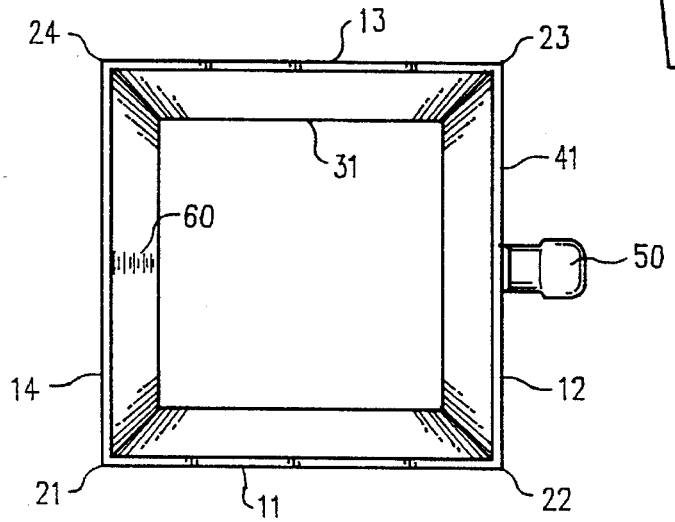
FIG. 2 is a top view.

As shown in the drawings, the preferred scoop for compacting and molding masonry mixtures in accordance with the present invention includes a plurality of side wall panels 11, 12, 13 and 14 of equal or similar dimensions and of equal or similar slightly tapered design. The tapered sidewall panels are joined together along their longer sides; FIG. 2, 21, 22, 23, 24, to form a multisided, open ended, tapered scoop. A handle 50, as shown in FIG. 3 is centered top to bottom and side to side and attached to one side 12 of the scoop. This scoop, when formed by the joining of its sides, which taper to a smaller measure at the base 31, includes an opening at its base of smaller area than that of its top 41. The opening formed at the top of the scoop allows for a volume of masonry mixture to be scooped up.

Regular gradient marks 60, as shown in FIG. 2, on the interior walls of the scoop allow for measuring the amount of mixture scooped up.

Preferably, the scoop is made of sturdy, lightweight metal or molded plastic construction, reinforced where its sides are joined and at its base for withstanding the impacts of compacting the mixture contained within.

The scoop is utilized by grasping the handle 50 and, with a scooping motion it is filled with masonry mixture which is piled in a loose mound on a work surface or in a tub.

In a continuous motion, the scoop is lowered rapidly and impacted on its base on a solid work surface. Multiple impacts and varying force increase the density of the material being compacted and molded as it is funnelled downward within the tapered scoop. The mixture, therefore compressed, can not fall out of the open base of the scoop. The inner gradient marks 60, FIG. 2, of the masonry scoop allow the quantity of masonry mixture induced into the scoop to be measured, if necessary, and the amount of the compaction to be regulated and standardized for each individual masonry paver installation.

After the mixture is compacted and molded with the masonry scoop, the scoop is then inverted and its top tapped lightly on a work surface. Both ends of the scoop are open, therefore no vaccum exists within the scoop, and the compacted, molded and premeasured masonry mixture slides out easily onto the work surface. It is best to immerse the empty masonry scoop in water every two uses to aid in ejecting the compacted masonry mixture.

The resultant preformed masonry mixture is able to support masonry pavers, or the like, better than a mixture piled up simply with a trowel or shovel because its tapered compacted and molded structural design deflects the load bearing down from the molded mixture's vertical axis and redirects the thrust into its sidewalls and its spreading base. This design greatly reduces the possibility of pavers, or the like, sinking during installation.

By having this scoop formed in the manner shown, its use allows the scooping up, compacting and delivery of a compacted, molded and measured amount of masonry mixture for masonry paving systems, or the like, without the use of additional utensils or tools to fill the scoop, speeding the operation as only one hand is needed to scoop, compact, mold, measure and deliver a specific amount of masonry mixture.

Larger masonry scoops could be developed with two handles to deliver a larger, heavier molded masonry mixture.

While there have thus been shown and described what are considered at present to be the preferred embodiments of the present invention which fulfill all the objects and advantages sought therefor it will be appreciated by those skilled in the art that many changes, modifications, variations and other uses and applications of the subject invention will become apparent after considering this specification and the accompanying drawings. All such changes, modifications, variations and other uses and applications which do not depart from the spirit and scope of the invention are deemed to be covered by the invention and the invention is not to be considered limited what is shown in the drawings and described in the specification.

I claim:

1. A scoop for the compaction, molding and measuring of masonry mixtures comprising: a multisided open ended tapered scoop formed of at least three tapered sidewall panels, each panel having approximately equal shapes and dimensions, the panels joined together along their sides with each side tapering down to a smaller measure at the base of the scoop to form a lower opening in the scoop which is smaller than the opening formed by said sides at the top of the scoop; gradient marks located on at least one of the panel walls on a surface located inside of the scoop; and a means for grasping the stoop located on the exterior face of at least one of the panels; whereby the top opening comprises a means for receiving a masonry mixture to be compacted, the gradient marks comprise a means to regulate the amount of compaction of the mixture, and the smaller opening provides a means to allow the compacted mixture to exit the top opening to slide out of the scoop in a molded volume.

* * * * *